United States Patent [19]

Ballard

[11] 4,100,395

[45] Jul. 11, 1978

[54] EXPANDED ELEMENT RADIANT HEATING DEVICE

[75] Inventor: Jules Ballard, Teaneck, N.J.

[73] Assignee: Glenro, Inc., Upper Saddle River, N.J.

[21] Appl. No.: 700,944

[22] Filed: Jun. 29, 1976

[51] Int. Cl.[2] ..... H05B 3/26; H01C 1/14; H05B 3/08

[52] U.S. Cl. ..... 219/356; 219/345; 219/357; 219/542; 338/208; 338/312; 338/332

[58] Field of Search ..... 219/346, 347, 350–357, 219/443, 445, 451, 463–468, 536, 537, 539, 541, 542; 338/206, 208, 279–283, 293, 306, 312–314, 321, 322, 332, 329, 328, 212, 278; 339/276 R, 276 C, 276 F, 276 T, 263 R, 263 L; 361/306

[56] References Cited

U.S. PATENT DOCUMENTS

| | | | |
|---|---|---|---|
| 1,393,427 | 10/1921 | Christoph | 219/443 |
| 1,526,338 | 2/1925 | Haynsworth | 219/357 |
| 1,542,967 | 6/1925 | Shoenberg | 219/355 |
| 1,565,539 | 12/1925 | Woodson | 219/546 |
| 1,733,984 | 10/1929 | Heintz | 338/312 |
| 1,962,041 | 6/1934 | Spong | 338/208 |
| 2,279,445 | 4/1942 | Clancy | 338/332 |
| 3,525,850 | 8/1970 | Hager, Jr. | 219/542 |
| 3,567,906 | 3/1971 | Hurko | 219/467 |
| 3,651,304 | 3/1972 | Fedor | 219/200 |
| 3,757,083 | 9/1973 | Dietz et al. | 219/356 |
| 3,833,793 | 9/1974 | McWilliams | 219/463 |
| 3,835,435 | 9/1974 | Seel | 338/280 |
| 3,860,790 | 1/1975 | Maake | 338/283 |

FOREIGN PATENT DOCUMENTS

| | | | |
|---|---|---|---|
| 562,701 | 7/1944 | United Kingdom | 338/206 |
| 440,153 | 12/1935 | United Kingdom | 219/443 |

*Primary Examiner*—J. V. Truhe
*Assistant Examiner*—Bernard Roskoski
*Attorney, Agent, or Firm*—Leo C. Krazinski

[57] ABSTRACT

A heating device having a sinuous, expanded metal heating element of high intensity and quick response mounted upon chemically inert non-woven alumina-silica filler refractory material. The heating element is fabricated of metal sheeting by slitting and expanding it to a selected shape, mesh size, strand width and gauge to provide uniform distribution of radiant energy over the entire face area of the heating element at elevated temperatures in which the watt density and heating element area are not limited by available voltage and temperature.

9 Claims, 12 Drawing Figures

Fig. 4.
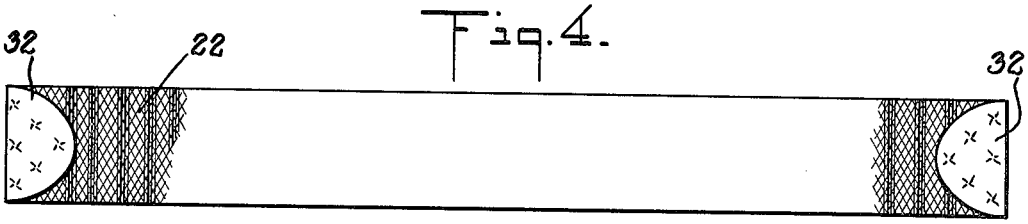
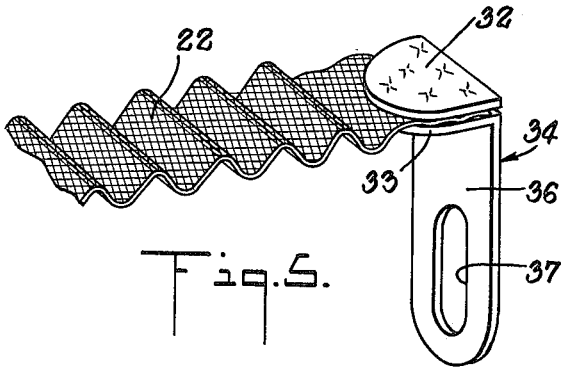
Fig. 5.
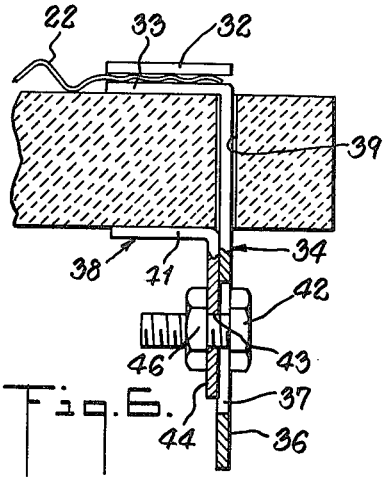
Fig. 6.
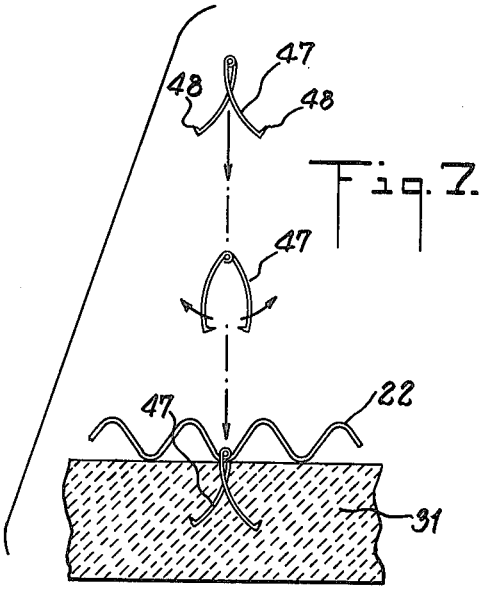
Fig. 7.
Fig. 8.
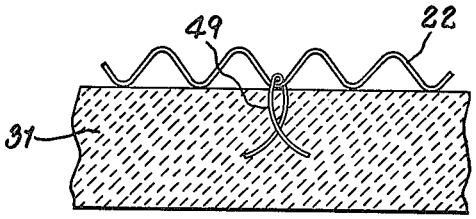
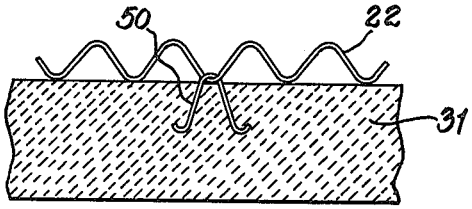
Fig. 9.

Fig. 11.
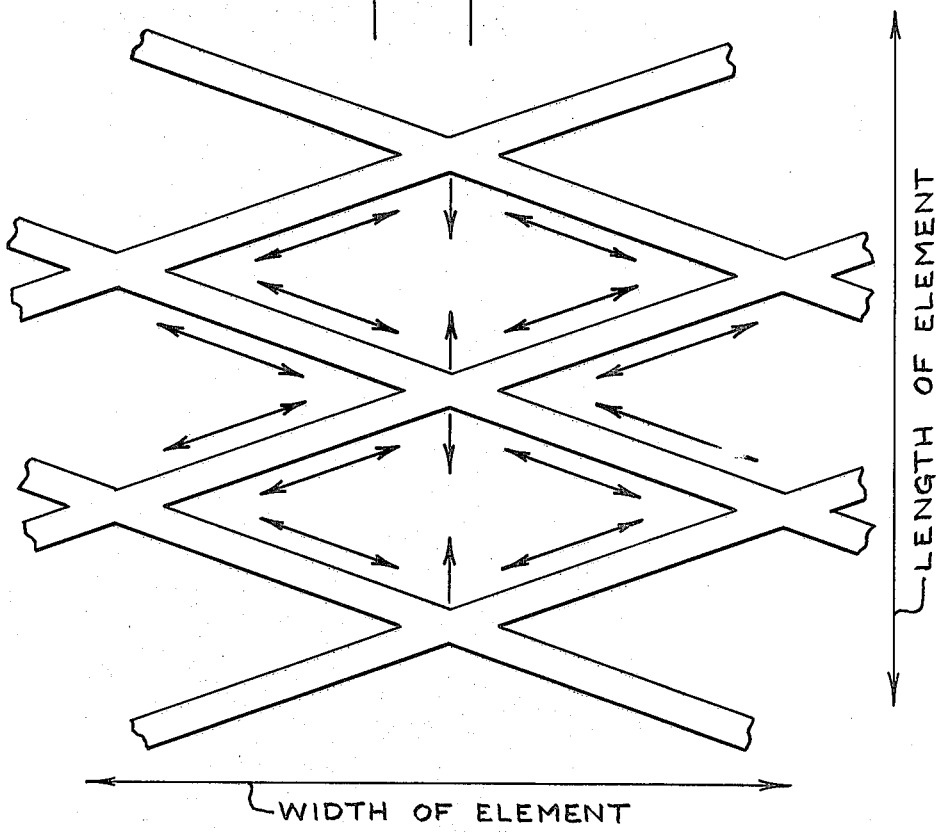
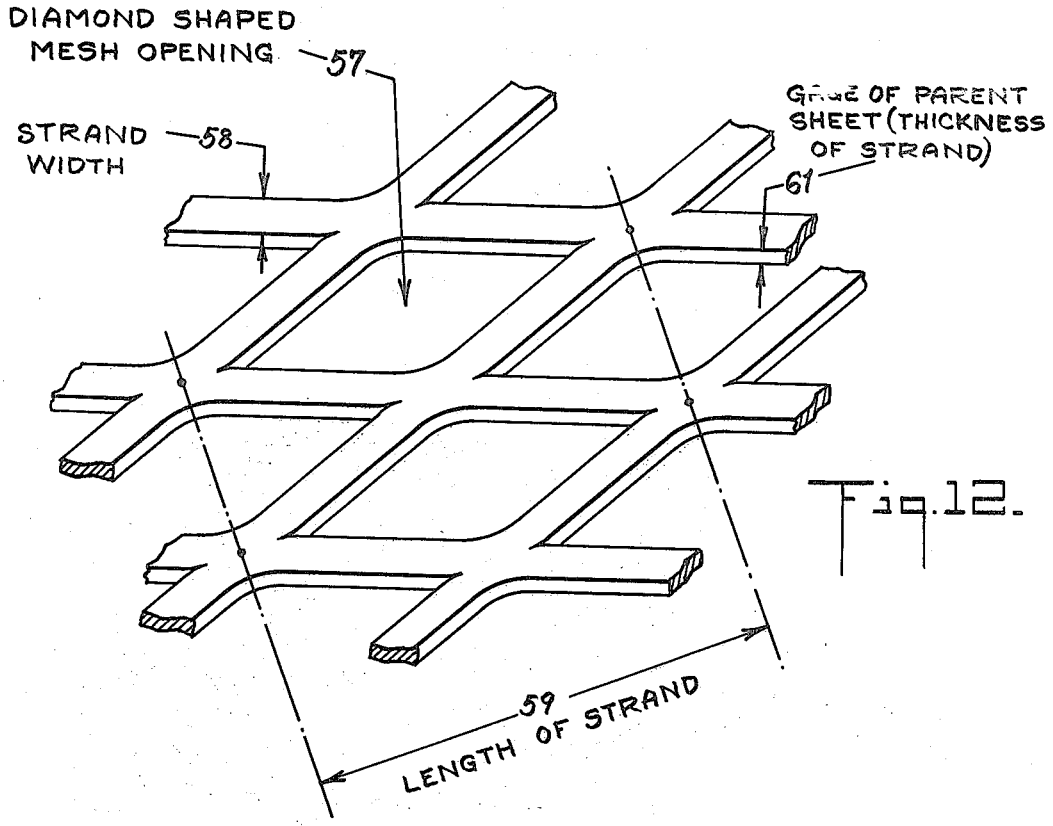
Fig. 12.

EXPANDED ELEMENT RADIANT HEATING DEVICE

BACKGROUND OF THE INVENTION

The present invention relates to electric heaters and, more particularly, to an electrical infrared radiant heating unit which includes one or more sinuous, perforated and expanded foil material mounted upon refractory material. The heating unit is adapted for heating, drying, curing, tempering, shrinking and the like in applications necessitating a fast response uniform radiant heat and the ability to operate in a 100° to 2000° F. range at high watt densities.

DESCRIPTION OF PRIOR ART

Metallic foil heating elements mounted on refractory material are well known, as shown in U.S. Pat. Nos. 2,682,596, and 3,525,850. The use of expanded metal as a heating element is not new, as seen in U.S. Pat. Nos. 1,396,871 and 2,570,692, nor are heating units utilizing expanded metal elements new, as seen in U.S. Pat. Nos. 2,087,573, 2,129,046 and 3,798,417.

Fast response heaters have been available in prior art heaters, but have several serious shortcomings. Of these, the radiant quartz tube type of heater consisting of a wire filament element inside of a quartz tube has been in use for many years. However, in order to take advantage of the high concentration of heat available from the quartz tube enclosure, it must be mounted in some kind of reflector unit to focus or distribute the radiant energy more uniformly over the target area.

The efficiency obtained from this type of heater is variable and rapidly diminishes as the reflector becomes coated with process effluent, condensed fumes, oxidation, and dust from the product or circulating factory air. The compensatory increase in power required to maintain process temperatures results in increased energy costs, short heater life and variable product quality.

Due to the non-uniform heat pattern produced by the narrow tube in its reflector it must always be oriented across the web to avoid striation of the heat pattern and even then, only at a distance from the product which would render a more uniform heat pattern.

Quartz tubes behave as a window to wavelengths below 2.4 microns and transmit most of their energy in this range of 0.4 to 2.4 microns. However, they absorb and block wavelengths above 2.4 microns so that only a small percentage of the total available energy is radiated beyond this region. Since most organic materials and also water most strongly absorb radiant energy in the 3 to 4 micron range, it is evident that this limitation can be a serious shortcoming.

Another type of heater utilizing a foil or thin ribbon, approximately 0.002 in. thick supported by a refractory material as in U.S. Pat. No. 3,525,850, also has a rapid response. While it has a relative high ratio of element surface area to total heater face area, it is limited in that (a) the Waspalloy element operating temperature cannot exceed 1550° F, (b) running the unit at higher temperatures shortens the element life rapidly, (c) the watt-density is relatively fixed and (d) after 72 hours of running at 1550° F, the element begins to sag, looping away from the refractory material between holddown points. The degree of catenoiding or "sag" increases with use, creating a non-uniform heat pattern with subsequent uneven heating of the processed material. When used in close proximity to the product in the "sag" condition, a definite potential hazard exists.

It is common knowledge that the life of a heating element of any alloy is a function of its thickness and operating temperature, so that as the operating temperature is increased, its thickness also must be increased to obtain an equivalent life expectancy.

Laboratory tests have shown that to achieve a temperature higher than 1550° F obtained with a 0.002 in. thick foil element, 230VAC source, there are two options:

(a) to decrease the resistance by reducing the total length of the heating elements, in which case the higher current resulting in higher operating temperature would forshorten the element life.

(b) To increase the current flow and maintain the operating life by increasing the thickness of the element, in which case the width of the element must be reduced to maintain the cross-sectional area for the required electrical resistance. This method results in slowing down the response time with either a less uniform heat pattern for the identical face area or conversely, a smaller heater-face area radiating to the product. For example, a foil type heater of predetermined face area, operating at 1550° F, at 4.0 KW per square foot and 230 volts utilizes elements that are 0.002 in. thick × 1 in. wide. To maintain the same cross-sectional area with a 0.004 in. thick element would require a reduction of its width to 0.5 in., thereby increasing the space between elements by an additional ½ in. within the heater-face area. This adversely affects the uniformity of heat pattern radiated. To restore the uniformity would require bringing the elements as close as they were originally, but consequently, reducing the total size of the radiating area. Since the rapid response of this type of heater is directly dependent upon the thickness of the element, increasing the foil thickness to achieve adequate life at a higher temperature can only be done at the expense of an increase in the response time.

SUMMARY OF THE INVENTION

It is a primary object of this invention to provide an industrial process heater which does not have the disadvantages associated with the prior art heaters.

It is another object of the present invention to provide a radiant infra-red heater with the flexibility of operating over a wide range of watt-densities at any given design temperature, up to 2000° F, within the confines of any given heater-face area and line voltage.

Another object is to provide a heater having elements evenly disposed and radiating a uniform pattern of energy within a given area and line voltage.

Still another object is to provide a heater module with a rapid response time which can function within a high operating temperature range, 1000°–2000° F, yet be independent of the thickness of the element, watt-density and temperature.

Yet another object is to eliminate the sagging tendency of the prior art heating elements operating at high temperatures.

A further object is to provide a heater which operates within the range of wavelengths peaking between 2.4 and 4 microns, known to be strongly absorbed by organic materials and water.

Yet a further object is to design a particular response time into the heater where it is essential to a process, for example, where it must be fast enough so that the product is not damaged yet slow enough to accommodate a control such as a zero-cross thyristor proportional controller, where the rate of "blinking" of the heater is clearly visible as an "on" and "off" sequence which progressively decreases as the power is cut back from the maximum.

In accordance with the present invention, the foregoing objects are accomplished by providing an expanded element radiant heating device which comprises a plurality of sinuated expanded heating elements with terminals at each end and fixedly mounted upon a chemically inert, non woven, alumina silica refractory material, in turn assembled into a casing.

BRIEF DESCRIPTION OF THE DRAWINGS

A preferred embodiment of the invention has been chosen for purposes of illustration and description and is shown in the accompanying drawings, forming a part of the specification, wherein:

FIG. 4 is a plan view of a corrugated, expanded heating element shown secured to terminals at its ends.

FIG. 5 is an enlarged perspective view of one end of the heating element shown in FIG. 4 with its terminal connection shown in greater detail.

FIG. 6 is a sectional view of one end of the heating element assembled onto the refractory material.

FIG. 7 is an exploded sectional view showing three stages of application of an anchoring device for securing the heating element to the refractory material.

FIG. 8 is a sectional view showing another type of anchoring device from that of FIG. 7.

FIG. 9 is a sectional view showing still another type of anchoring device from that of FIG. 7, which anchoring device is adapted for use in a stapling machine.

FIG. 11 is an enlarged plan view of a section of an expanded element showing expansion thereof when heated.

FIG. 12 is an enlarged perspective view of a section of an expanded heating element describing the parts thereof.

Figure 1:
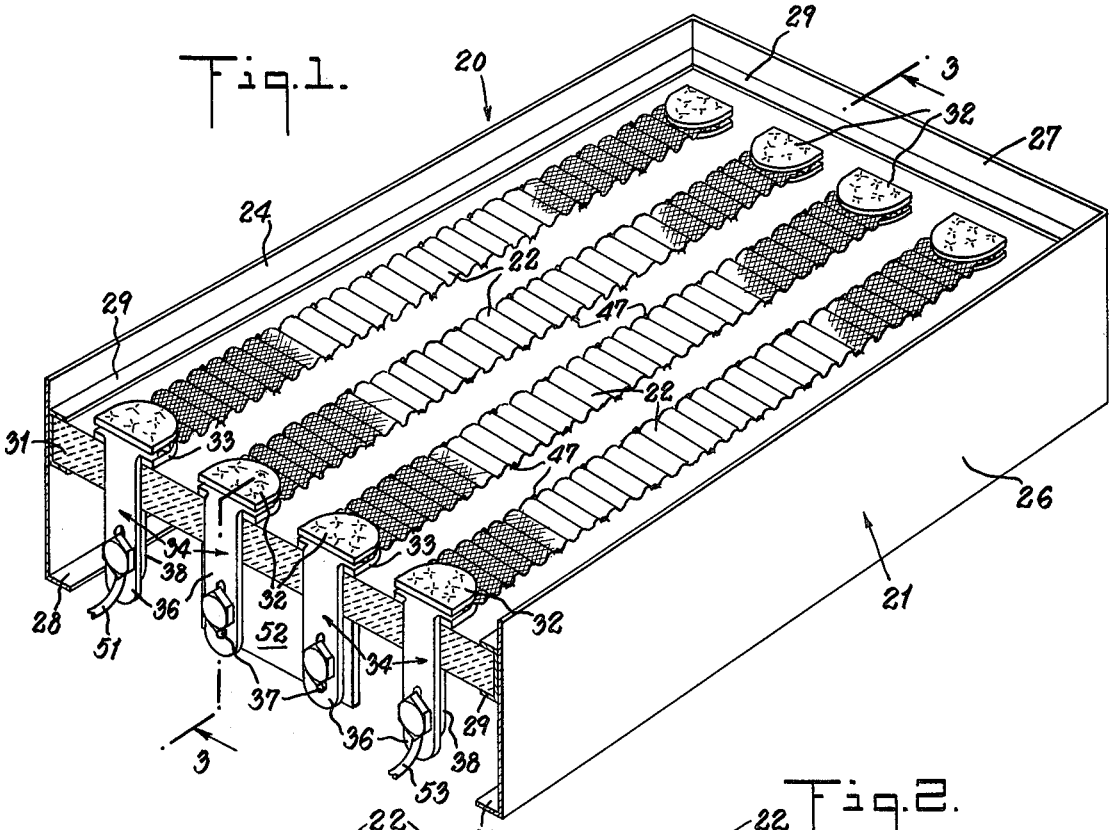
FIG. 1 is a front perspective view, partly in section with the left end casing section removed of an expanded element radiant heater in accordance with the present invention.
Figure 2:
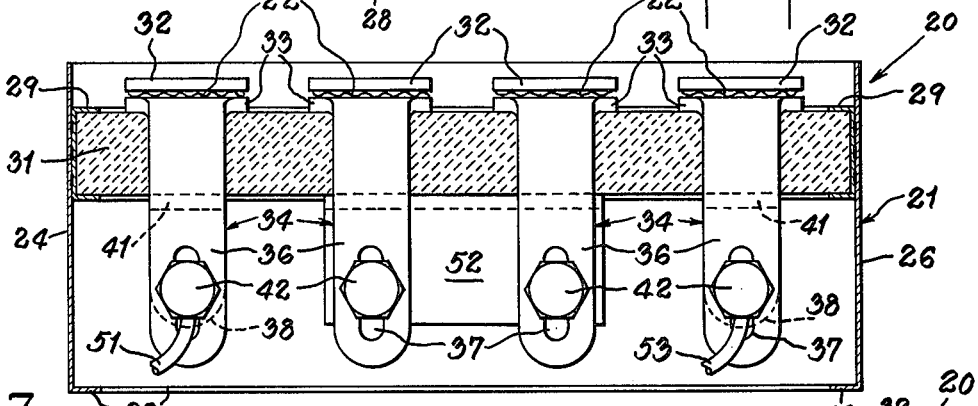
FIG. 2 is an elevational view, partly in section, looking into the left end of FIG. 1.
Figure 3:
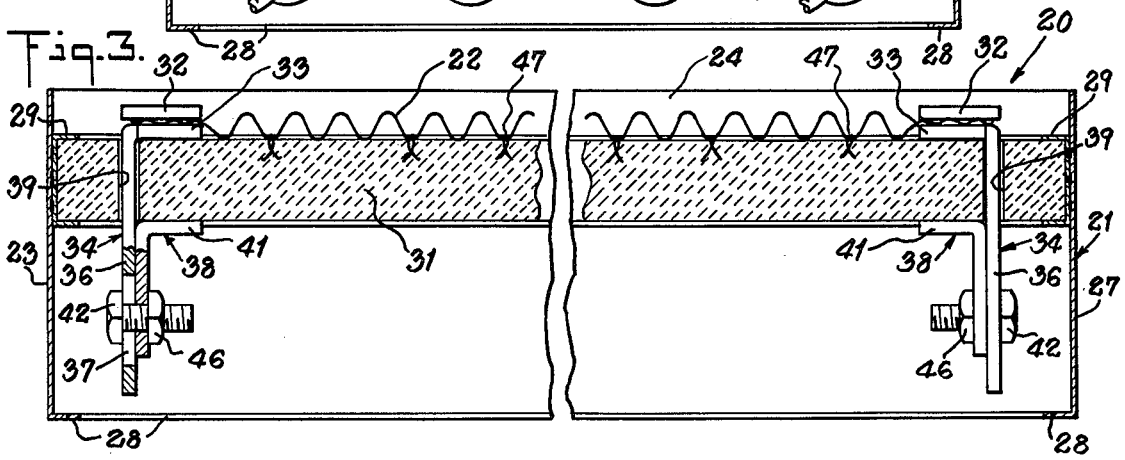
FIG. 3 is a sectional view taken along line 3—3 of FIG. 1 in the direction of the arrows.

Referring now to the drawings in detail, particularly to FIGS. 1, 2 and 3, there is shown an expanded element radiant heating device 20 which generally comprises a casing 21 housing four expanded heating elements 22. The casing 21 is made of sheet metal of appropriate thickness and has four sides, a front 23, a left side 24 and a right side 26, as viewed in FIG. 1, and a rear side 27, in which inturned flanges 28 are provided at the bottom edges thereof. The casing 21 is open at its top and bottom and, as shown, channels 29 are secured, such as by welding, in alignment along the inner surfaces of the sides 23, 24, 26, 27, adjacent the tops thereof for supporting a refractory backing 31. At this point it may be mentioned that initially the casing is formed of two parts, front side 23 welded to left side 24 and right side 26 welded to rear side 27 and the channels 29 welded in place. The two parts are then aligned and the refractory backing 31 is slid into place on the channels, after which the two parts are welded at their joints to form the closed casing 21.

The heating element 22 consists of an expanded metal or perforated metal of predetermined width, which is made of an alloy that can withstand operating temperatures of about 2000° F without excessive oxidation or fatique failure. Such high temperature alloys as the INCONEL, 600, 617, HAYNES 188, RENE 41 and UDIMET 700 are particularly suitable for the purpose in a range of thickness of from 0.001 to 0.020 but preferably in the range of from 0.005 to 0.015 inch. See Appendix A for composition of said four trademark alloys. The perforated metal is expanded to the mesh size, strand-width, and strand-length to the desired electrical resistance for the particular area, temperature, and watt density requirements of the application. The expanded metal is then corrugated or sinuated by a factor of 1.1 to 2.0 (but preferably in the range of 1.2 to 1.5) to improve the watt-density per unit area, and enhance the heat up and cooldown response rate by elevating a major portion of the element away from its "back-up" refractory. This reduces the area of contact between the element and refractory to virtually point-contact its overall effect enhancing the cooldown response time of the heater, as is evident in FIGS. 7, 8 and 9.

One inch of each end of the now corrugated metal is flattened by a press or a pair of rollers (not shown). Each of the flattened ends is then sandwiched between a stainless steel platelet 32 and a horizontal portion 33 of a terminal bracket 34, as seen in FIGS. 4, 5 and 6, and rigidly secured together by either resistant or heliarc welding, so that the three pieces of metal form an excellent mechanical and electrical connection. The gauge of the platelet 32 and terminal bracket 34 should be about 2.5 to 3 times the thickness of the stranded metal in order to dissipate the heat from the heating element 22. The shapes of the platelet 32 and horizontal terminal portion 33 are critical and both should be of the same shape substantially. It has been found that use of a platelet having a straight, transverse edge traversing the width of the element 22 resulted in early failure at various points along the transverse edge. It was not until the platelet shape was changed to a "delta" configuration, as shown in FIGS. 4 and 5, that long life of the heater design of this invention was achieved. The accepted platelet shapes range from a truncated square, semi-round, parabolic to a truncated triangle, all of which are loosely defined by the term "delta".

As seen in FIGS. 4 and 5, the terminal bracket 34 includes a depending leg 36 having an elongated slot 37 at the lower portion thereof. The slot 37 is provided in order to properly secure the terminal bracket 34 to the refractory backing 31. For this purpose, as shown in FIG. 6, a right angle bracket 38 is assembled to the terminal bracket 34 after the depending leg 36 is passed downwardly through an opening 39 in the refractory backing 31. The upper horizontal leg 41 of the bracket 38 is pressed upwardly against the under side of the refractory backing 31 and a bolt 42 passed through an opening 43 of the vertical leg 44 of the bracket 38 and thence through the slot 37 and secured in place by a nut 46.

The above procedure takes place at each end of the heating element 22, so that each heating element is resting on the refractory backing 31. The heating element is further secured to the refractory backing along its length by suitable staples. As seen in FIGS. 7, 8 and 9, three different types of staples are shown and these staples are preferably made of the same alloy as that of the corrugated metal used in the heating element 22. However, nichrome could be used. Only a short staple ½ inch to ⅝ inch long is required, as the small area of contact made between the staple wire at right angles to the heating element strand transfers so little heat that it is not necessary to dissipate it back through refractory backing 31. One type of staple 47, shown in FIG. 7, has outwardly disposed, upturned prongs 48 in its relaxed condition, as shown in the uppermost and lowermost positions. In attaching the heating element strand to the refractory backing the legs of the staple are pulled apart, so that the prongs 48 are facing inwardly, as indicated in the intermediate position of FIG. 7, the legs lowered to straddle a strand and then pressed directly downwardly into the refractory backing 31. The shape of the staple legs causes them to be deflected outwardly in an arcuate manner, thereby anchoring the particular strand, as seen in the lowermost position in FIG. 7. In FIG. 8 the staple 49 is similar to that of FIG. 7 except that it does not have any anchoring prongs while the staple 50 in FIG. 9 is somewhat similar to that of FIG. 7. The strands of the heating element 22 are accordingly firmly attached to the refractory backing 31 by machine stapling one strand alternately along each side of the heating element staggered at approximately 2 inch centers along the length thereof, as seen in FIGS. 1 and 3.

Figure 10:
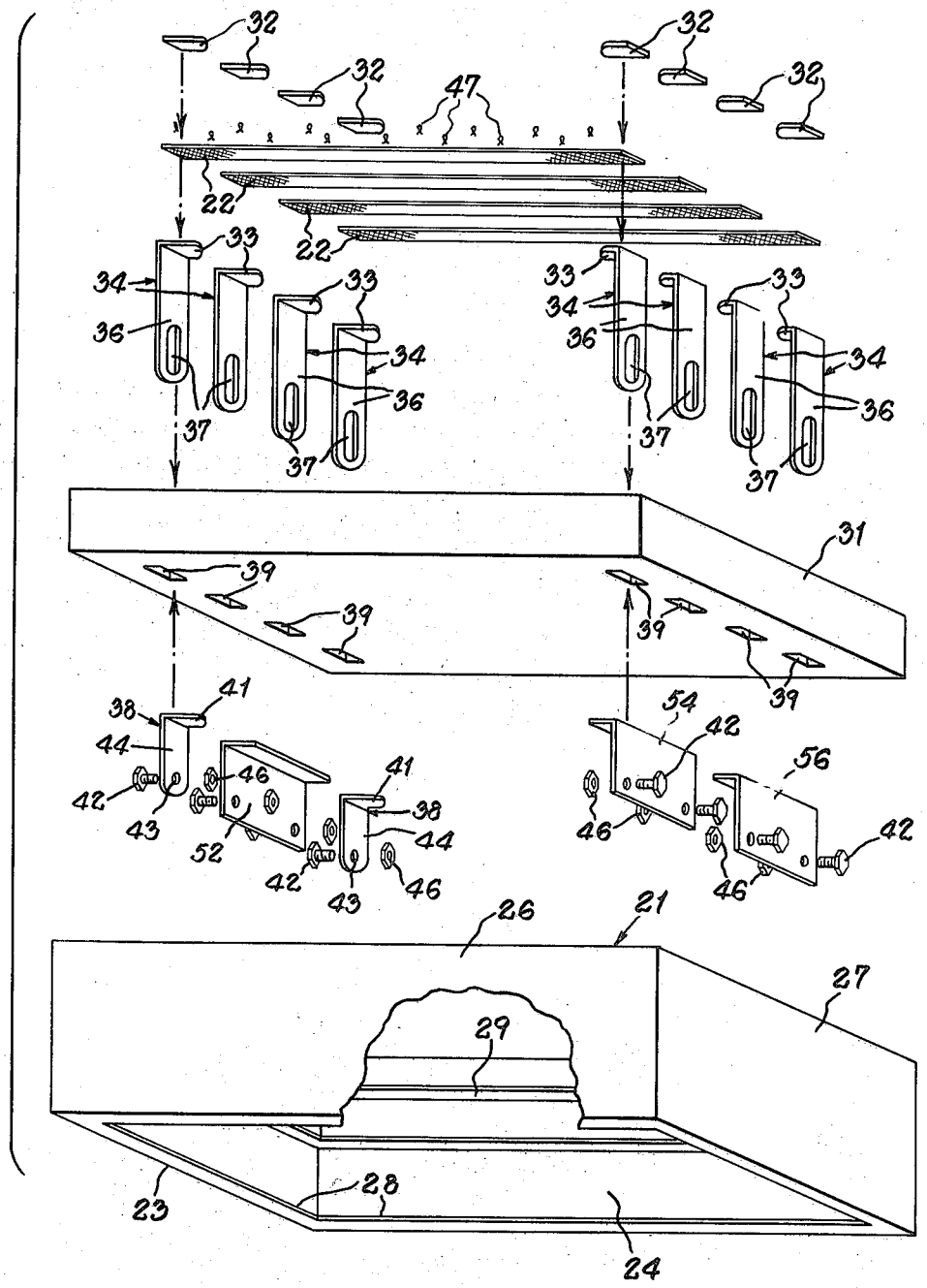
FIG. 10 is an exploded view of the component parts of the expanded element radiant heater.

Referring again to FIGS. 1 and 2, four heating elements 22 are shown for the heater 20 in which for electrical, serial continuity the left terminal bracket 34, as viewed in FIGS. 1 and 2, has a lead 51 connected to it, the two intermediate terminal brackets 34 are interconnected by a plate 52 and the right terminal bracket 34 has a lead 53 connected to it, both leads 51 and 53 being connected to a conventional source of power (not shown). At the rear side 27 of the casing 21 the first and second terminal brackets 34 and the third and fourth terminal brackets, reading from left to right in FIG. 10, are interconnected by plates 54 and 56, respectively, to provide for the serial electrical continuity at the rear of the heater 10.

Referring now to FIGS. 11 and 12, the present invention utilizing expanded metal elements in conjunction with a "back-up" material of non-woven chemically inert refractory fiber, provides flexibility in the combination of design parameters, i.e., element temperature, radiating area, and watt-density; and also provides simultaneously a uniform distribution of radiant energy with a rapid response time, which combination of characteristics it is believed not available from any existing heater in the present state of the art. In addition, the present invention circumvents the prior art shortcomings, as mentioned hereinbefore. There are many instances particularly where, because of the area size, temperature and watt-density required and the line voltage available, that a heater either cannot be designed with wire, or ribbon elements or its design must be compromised to do so. The expanded metal element, with the ability to obtain high resistance with heavier gage material is able to fill this requirement.

The inherent flexibility obtained from the expanded, or perforated metal elements, in combination with a refractory material, is primarily a function of the number of its physical parameters that can be varied to accommodate a heater design in terms of uniformly blanketing the available processing area with the correct temperature and KW per sq. ft., as determined by the product mass and material. These physical parameters include a number of factors, see FIG. 12, such as: (a) size of the mesh opening 57, which is defined as the percentage of open area, that is, the number of openings per square inch; (b) the width of the strand 58 which is self evident in FIG. 12; (c) length of the strand 59, which is defined as the length of the center line distance between adjacent openings in the same line and plane; (d) the degree of expansion or stretch, which is equivalent to the width of the diamond or the centerline distance between the centers of the width of 2 diamonds joined by a common strand; (e) the shape of the mesh, which is the ratio of width to length or the geometric shape, such as a diamond, hexagon, etc.; (f) the gauge 61 of the strand, that is, its thickness; and (g) the alloy composition of the metal in the strand.

Depending upon the line voltage, the area to be covered, optimal processing temperature and KW requirement, the electrical resistivity of the heater elements is determined. The expanded metal is then specified as to the mesh, strand width and length, gauge and alloy required. In a sense, one can consider this element in the nature of an expansible resistance which can be stretched in two dimensions in an accordian-like manner to cover a particular area; while the temperature and watt-density are controlled by length, width, thickness of the strand and the number of strands (conductors) per square inch of element. This particular feature allows a heater to be constructed so that the element may be "spaced out" over the entire heater-face area, providing a uniformly radiant source of energy.

The prerequisite of utilizing thin enough foil to achieve low thermal mass and thereby fast response time is completely eliminated with expanded metal elements in that we are in essence replacing a large conducting member with its equivalent in a multiplicity of smaller ones, each being a small fraction of the solid conductor. This, in itself, allows an increase in the thickness over the single conductor without sacrificing speed of response, e.g., a 0.002 in. foil operating at 1500° F (230V) was directly substituted by an 0.008 in. thick expanded metal element and achieved the same temperature and same response time.

ELEMENT COMPARISON WITH EQUAL RESPONSE TIMES

| Type of Element | Gauge | Line Volts | Amps. | Element Temperature |
|---|---|---|---|---|
| Ribbon or Foil | .002 | 230 | 37.5 | 1500° F |
| Expanded Metal | .008 | 230 | 37.5 | 1800° F |

Further improvements in the heaters response time were made possible by corrugating or sinuating the element across its width. One advantage gained is that most of the sinuated element is elevated away and stands off from the refractory surface with the exception of those points where the individual strands in the trough of the sinuation are touching. With the area of contact being so small, heat transfer to the back-up refractory by conduction is minimal, permitting the surface to run considerably cooler.

Another advantage of sinuating is that the elevated element encourages cooler air to readily circulate around the individual strands, further enhancing the cool-down time when power is interrupted. These improvements in response time are significant enough to have been translated into the use of a thicker element, thereby, element life has been extended and operating temperatures increased beyond those attainable with a flat element. Sinuating the element by a factor of from 1.1 to 2.0 is also employed to increase the watt-density per sq. ft. by condensing a larger radiating area into a shorter one within the same heater-face area. It is also useful in that it adds another dimension to design flexibility. The elasticity it imparts to the element enables it to "hug" against the surface of the refractory when mounted at both ends.

Another problem, "sagging" of the element, is primarily caused by elongation of the element at elevated temperatures, an irreversible condition which becomes progressively aggravated with continued usage. It has been established that, providing the length of the "diamond" is across the width of the element, see FIG. 11, sagging is completely eliminated by maintaining a minimum ratio of from 2:1 to 10:1 between the length and width of the mesh opening which we shall consider to have a "diamond" shape.

In FIG. 11 it is shown by arrows that the direction of expansion of the individual strands is primarily in the width of the element with only a small component being in the length-wise direction. The expansion in the length of the strand across the width dimension of the element is far greater than the length-wise component in the width of the "diamond", thereby stabilizing the elongation of the element. Laboratory tests and practical experience, in fact, have shown this smaller component to be insignificant since it is actually neutralized by the pantograph-like action of the joined strands which tend to pull the width dimension of the "diamonds" together.

The choice of refractory "back-up" material is an important facet for if it absorbs energy from the heating elements it would re-radiate heat to the product for some time after the elements had been turned "off" and extend the response time, thus offsetting the benefits derived from the use of high temperature expanded metal elements. The refractory back-up material 31 to which the heating element 22 is mounted is structured of a low density Alumina-Silica fiber having a low thermal conductivity of from 0.2 to 1.5. BTU/sq. ft./in/hr./° F, a high emissivity (around 0.8) and is chemically inertand electrically non-conductive at elevated temperatures (around 2300° F). The approximate chemical composition of the material is:

$S_iO_2$ — 40–51.6% by wt.
$Al_2O_3$ — 41.8–55% by wt.
$T_iO_2$ — 1.6% by wt.
$F_2O_3$ — 0.9% by wt.
$M_gO$—0.3% by wt.
$Na_2O$ — 0.006% by wt.

The selection of the present refractory is based on its ability to yield one of the highest element temperature for a given power input when employed as a back up material, as well as its ability to enhance its cooldown response time. Similar types of materials are available from Babcock and Wilcox as KAOWOOL "M" block or from Johns-Manville as CERAFORM or CERAFELT The approximate chemical composition of both trademark materials are:

| KAOWOOL | | CERAFORM | |
|---|---|---|---|
| $S_iO_2$ | 51.6% | $S_iO_2$ | 51.8% |
| $Al_2O_3$ | 41.8% | $Al_2O_3$ | 42.9% |
| $TiO_2$ | 1.6% | $Fe_2O_3$ | 0.1% |
| $Fe_2O_3$ | 0.9% | MgO | 0.16% |
| MgO | 0.3% | $MnO_2$ | 0.01% |

-continued

| KAOWOOL | | CERAFORM | |
|---|---|---|---|
| $Na_2O$ | .006% | $K_2O$ | Trace |
| Ignition Loss | 3.794% | $Na_2O$ | 0.98% |
| | | S | 0.01% |
| | | Ignition Loss | 4.9% |

From the foregoing description, it will be seen that the present invention provides an improved high temperature rapid response radiant heating device capable of operating between 1000° F and 2000° F.

As various changes may be made in the form, construction and arrangement of the parts herein, without departing from the spirit and scope of the invention and without sacrificing any of its advantages, it is to be understood that all matters are to be interpreted as illustrative and not in any limiting sense. What is claimed is:

1. A high temperature rapid response heating device capable of operating between 1000° F and 2000° F, comprising at least one expanded, corrugated heating element having flat portions at each of its longitudinal ends, terminal means for each end of said heating element, said terminal means including a metallic terminal bracket of right angle configuration having a short leg of approximate delta shape and a long leg and a flat metallic platelet of approximate delta shape, said short leg being on one side of said flat portion and said platelet being on the other side of said flat portion when said short leg and said platelet are secured together with said heating element flat portion therebetween, means for rigidly securing said terminal means to said flat portions, a refractory backing for carrying said heating element, stapling means for securing strands of said heating element to said refractory backing at spaced intervals along the longitudinal length of said heating element, said long leg of each terminal bracket extending through said refractory backing, adjustable means associated with said long leg of each bracket for securing said terminal means and heating element ends to said refractory backing, a casing for carrying said heating element and refractory backing, and means within said casing for supporting said heating element and refractory backing.

2. A high temperature rapid response heating device capable of operating between 1000° and 2000° F, comprising at least one expanded, corrugated heating element having flat portions at each of its longitudinal ends, terminal means for each end of said heating element, said terminal means including a metallic terminal bracket of right angle configuration having a short leg and a long leg and a flat metallic platelet, said short leg being on one side of said flat portion and said platelet being on the other side of said flat portion, when said short leg and said platelet are secured together with said heating element flat portion therebetween, means for rigidly securing said terminal means to said flat portions, a refractory backing for carrying said heating element, stapling means for securing strands of said heating element to said refractory backing at spaced intervals along the longitudinal length of said heating element, adjustable means for securing said terminal means and said heating element flat portions to said refractory backing with said long leg of said bracket extending through said refractory backing, said means for securing said terminal means to said refractory backing including a second right angle bracket having one leg adjustably secured to the long leg of said terminal bracket and having another leg for exerting pressure against an underside of said refractory backing, a casing for carrying said heating element and refractory backing, and means within said casing for supporting said heating element and refractory backing.

3. A heating device in accordance with claim 2, wherein said long leg of said terminal bracket has an elongated slot and bolt-nut means are provided for securing both of said brackets to said refractory backing, pressure being applied by said short legs of said terminal brackets and said other legs of said second right angle brackets upon the refractory backing to fasten the heating element thereto.

4. A heating device in accordance with claim 3, wherein said supporting means include channels carried along the inner periphery of said casing.

5. A heating device in accordance with claim 1, wherein said stapling means include staples anchored within said refractory backing.

6. A heating device in accordance with claim 5, wherein the ends of said staples are provided with outwardly disposed, upturned prongs.

7. A heating device in accordance with claim 5, wherein said staples have a length of about $\frac{1}{2}$ to $\frac{5}{8}$ inch.

8. A heating device in accordance with claim 5, wherein said heating element is attached to the refractory backing by stapling alternately along each side of the heating element with said staples being staggered at about 2 inch centers.

9. In combination, an expanded sinuated heating element having a flat portion at each end of the heating element, a platelet in contact with one side of each of said flat portions, a right angle bracket having a leg in contact with another side of each of said flat portions, and means rigidly securing said platelet and bracket leg to said respective flat portions each of said platelets and bracket legs being of substantially delta shape.

* * * * *